US006191678B1

(12) United States Patent
Edwards

(10) Patent No.: US 6,191,678 B1
(45) Date of Patent: Feb. 20, 2001

(54) TIME LAG FUSE

(75) Inventor: Carl H. Edwards, Elizabethtown, KY (US)

(73) Assignee: Cooper Industries, Inc., Houston, TX (US)

( * ) Notice: Under 35 U.S.C. 154(b), the term of this patent shall be extended for 0 days.

(21) Appl. No.: 08/937,019

(22) Filed: Sep. 24, 1997

(51) Int. Cl.[7] ..... H01H 85/0445; H01H 85/02; H01H 85/055; H01H 85/06

(52) U.S. Cl. ..... 337/16.3; 337/186; 337/187; 337/227; 337/228

(58) Field of Search ..... 337/144, 158, 337/164–166, 159–163, 186–190, 227, 292, 297, 280, 282, 201, 205; 29/623

(56) References Cited

U.S. PATENT DOCUMENTS

| | | | | |
|---|---|---|---|---|
| 4,177,444 | * | 12/1979 | Taki | 337/163 |
| 4,189,696 | | 2/1980 | Beswick et al. . | |
| 4,253,080 | * | 2/1981 | Howard | 337/159 |
| 4,409,729 | * | 10/1983 | Shah | 29/623 |
| 4,445,106 | | 4/1984 | Shah . | |
| 4,517,544 | * | 5/1985 | Spaunhorst | 337/164 |
| 4,560,971 | * | 12/1985 | Oh | 337/164 |
| 4,680,567 | | 7/1987 | Edwards . | |

OTHER PUBLICATIONS

Standard for Safety; Underwriters Laboratories, Inc.; Jan. 15, 1990; pp. 1–54 and Appendix.

Secondary Protectors for Communications Circuits; Underwriters Laboratories, Inc.; Jan. 30, 1996; pp. 1–64 and Appendix.

* cited by examiner

*Primary Examiner*—Leo P. Picard
*Assistant Examiner*—Anatoly Vortman
(74) *Attorney, Agent, or Firm*—Burns, Doane, Swecker & Mathis LLP

(57) ABSTRACT

A fuse includes a housing having first and second ends and an outer diameter of about 3 mm. The fuse further includes a nonconductive core arranged inside the housing and a fuse element wound spirally around the nonconductive core. An end cap is mounted on each of the first and second ends of the housing and each end of the fuse element is connected to a respective end cap. The fuse is rated at approximately 350 mA and 600 volts direct current and can withstand 100 pulses of 14 peak amps on $^{10}/_{1000}$ wave form without damage. The fuse element is wound on the nonconductive core at about 120 to 150 turns per inch, and the fuse element is a Cu/Ag wire having a diameter of about 0.002 inches. One method of making such a fuse comprises the steps of spirally winding a fuse element on an elongated nonconductive core, threading sequentially on the wound core an assembly that includes a first conductive end cap, a fuse housing, and a second conductive end cap, repeating the above-identified threading step until a plurality of assemblies have been threaded on the wound core, soldering the fuse element to each end cap, and severing the wound core between each assembly.

29 Claims, 1 Drawing Sheet

TIME LAG FUSE

BACKGROUND OF THE INVENTION

1. Field of the Invention

The present invention relates to a fuse, and in particular, to a time lag fuse designed to withstand certain peak inrush currents.

2. Discussion of Related Art

Time lag or time delay fuses are well known in the art. See, for example, U.S. Pat. Nos. 4,517,544; 4,189,696; 4,189,696; 4,680,567; 4,445,106; and 4,409,729. Such fuses are frequently in the form of spiral wound fuses. In a spiral wound fuse, the fuse element is spirally wound around a core that is internal to the fuse body.

However, most prior art spiral wound fuses were at least 5 mm in diameter and 15 mm long, with a voltage rating of only 250 volts. In fact, most spiral wound prior art fuses are 6 mm in diameter and about 32 mm long.

However, certain applications require fuses having a diameter of 3 mm and a length of about 10 mm. Furthermore, the Underwriters Laboratories recently changed the standards for endurance testing of certain fuses. See §28.2 of UL Standard 497A. The new standard requires certain fuses to have endurance conditioning such that they can withstand a 14 amp pulse having $^{10}/_{1000}$ microsecond wave form. Under this standard, the fuse must be able to withstand 100 pulses that reaches 14 peak amps within 10 microseconds and will decay to half-value in 1000 microseconds. Fifty of these pulses are to be at one polarity, and then the pulses are to be repeated at the opposite polarity.

Prior to the present invention, no 3×10 mm fuses were able to be made which would comply with the standard and which would have a 350 mA continuous ampere rating and 600 volts DC rating.

OBJECTS AND SUMMARY

It is an object of the present invention to provide a fuse that, among other things, meets the new UL Standard 497A and is able to have a rating of 350 mA and 600 volts DC.

It is a further object of the present invention to provide a small, efficient spirally wound fuse that fits in a 3×10 mm package.

It is yet another object of the present invention to provide an efficient method of manufacturing a spirally wound fuse.

According to one embodiment of the present invention, a time lag fuse includes an insulative housing having first and second ends and an outer diameter of about 3 mm. The fuse further includes a nonconductive core arranged inside the insulative housing and a fuse element wound spirally around the nonconductive core. An end cap is mounted on each of the first and second ends of the insulative housing and each end of the fuse element is connected to a respective end cap. The fuse is rated at approximately 350 mA and 600 volts direct current and meets the UL endurance conditioning test of withstanding 100 pulses of 14 peak amps on a $^{10}/_{1000}$ wave form without damage.

According to another embodiment of the present invention, the fuse element is wound on the nonconductive core at about 120 to 150 turns per inch, and the fuse element is a Cu/Ag wire having a diameter of about 0.002 inches.

According to the present invention, one method of making such a fuse comprises the steps of spirally winding a fuse element on an elongated nonconductive core, threading sequentially on the wound core an assembly that includes a first conductive end cap, a fuse housing, and a second conductive end cap, repeating the above-identified threading step until a plurality of assemblies have been threaded on the wound core, soldering the fuse element to each end cap, and severing the wound core between each assembly.

DETAILED DESCRIPTION OF PREFERRED EMBODIMENTS

Figure 1:
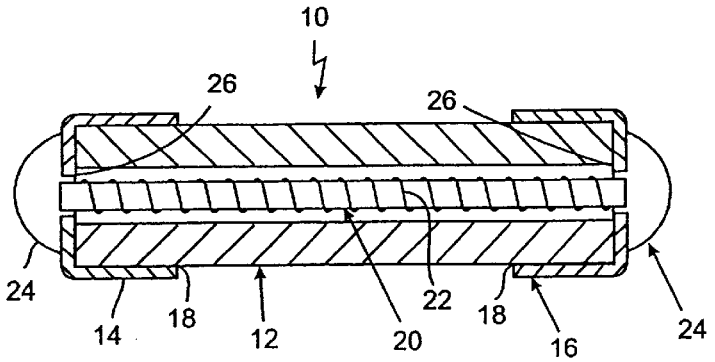
FIG. 1 is a cross-sectional view of a fuse according to the present invention.

FIG. 1 is a cross-sectional view of a fuse according to the present invention.

In a preferred embodiment, the length of the fuse is about 10 mm, and the diameter of the fuse is about 3 mm. However, the present invention is not limited to fuses of these particular dimensions.

The fuse 10 includes a fuse housing 12. The fuse housing 12 is made from a nonconductive material, preferably glass. The preferred length of the tube 12 is about 9.65 mm. The outer diameter of the tube 12 is about 2.54 mm, ±0.03 mm. The thickness of the wall of the fuse housing 12 is approximately 0.76 mm, ±0.05 mm. Accordingly, the internal diameter of the fuse housing 12 is about 1 mm. However, it should be appreciated that the present invention is not limited to a fuse having a fuse housing 12 of the exact dimensions set forth herein.

In a preferred embodiment, the fuse housing 12 is transparent. However, it is not necessary that the fuse housing 12 be transparent.

At each end of the fuse housing 12 is a fuse cap 14, 16. The fuse caps 14, 16 are made from a conductive material, such as metal. In a preferred embodiment of the present invention, each of the fuse caps extends over the fuse housing 12 for a distance of about 2 mm. However, the exact length of the fuse caps 14, 16 is not critical to the present invention.

The fuse caps 14, 16 are secured to the fuse housing 12 with an epoxy 18, or any other suitable adhesive.

Figure 2:
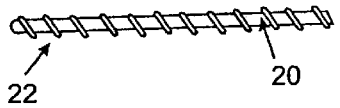
FIG. 2 is a view of a core element of a fuse according to the present invention.

Turning attention to FIGS. 1 and 2, the core 20 of the fuse is made from a nonconductive material. In a preferred embodiment, the core 20 is made of a thin stranded ceramic material, such as 3M's Nextel 312 ply-twisted yarn (390-1/4-2.7-170) 900 denier. Preferably, the Nextel yarn is supplied with an inorganic binder, which functions both as a glue and a lubricant. In the preferred embodiment, the outer diameter of the core 20 is about 0.018 inches. However, the present invention is not limited to this particular dimension.

In an alternative embodiment, a silicone core may be used instead of the core described in the preceding paragraph. Such a silicone core may be about the same diameter, i.e., 0.018 inches. A detailed description of such a silicone core is set forth in U.S patent application Ser. No. 08/600,363, the subject matter of which is hereby incorporated herein by reference.

The fuse element 22 is made from a 0.002 inch diameter wire that has a composition of 50% Cu/50% Ag. The wire has a resistance of 3.41 ohms per foot at 25° C., The Cu/Ag alloy wire is plated with a layer of tin having a thickness of about 0.0076 mm, ±0.0025 mm.

The wire fuse element 22 is wrapped around the core 20 with about 120 to 150 turns per inch. In a more preferred embodiment, the wire is wrapped with about 123 to about 137 turns per inch, preferably at about 130 turns per inch.

The core 20 spirally wound with the fuse element 22 at 130 turns per inch has a resistance of about 32 to 34 ohms per foot.

After the fuse element 22 is wound on the core 20, an assembly comprising the fuse housing 12 and end caps 14, 16 is mounted onto the fuse housing 12 and is then threaded onto the core 20, 22.

As can be seen in FIG. 1, each of the fuse caps 14, 16, has an opening 26 at a center portion thereof to enable the assembly to be threaded onto the core 20, 22.

Figure 3:
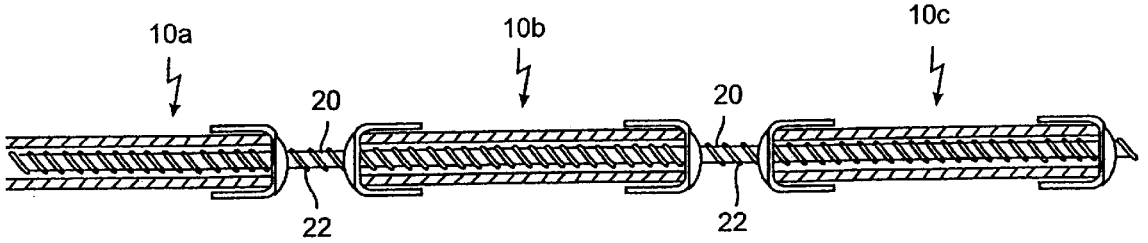
FIG. 3 is a view of a plurality of fuses in the process of being made.

As seen in FIG. 3, three assemblies 10*a*, 10*b*, and 10*c* are threaded on the core 20, 22. After the assemblies 10*a*, 10*b*, 10*b* are threaded onto the core 20, 22, each end cap 14, 16 is soldered to the fuse element 22 with a bead of solder 24. After the end caps 14, 16, are soldered to the core 20 and fuse element 22, the fuse elements 22 are severed between each of the fuse assemblies 10*a*, 10*b*, and 10*c* in order to complete the finished fuse 10.

According to at least on embodiment, the fuse 10, manufactured according to the teachings set forth herein will have an interrupt rating of approximately 6 amps at 600 volts DC and a fuse rating of 350 mA. Furthermore, the fuse will comply with UL Standard 497A paragraph 28.2 and will be able to withstand 100 pulses of 14 peak amps with a $^{10}/_{1000}$ microsecond wave form.

While a particular embodiment of the present invention has been described above, it will be understood by one of ordinary skill in the art that various modifications can be made without departing from the scope of the invention as defined by the appended claims. The present invention is considered to include such various modifications.

I claim:

1. A time lag fuse, comprising:

an insulative housing having first and second ends and an outer diameter of substantially 3 mm;

a nonconductive core arranged inside the insulative housing;

conductive means for withstanding 100 pulses that reach 14 peak amps within 10 microseconds and that will decay to a half-value in 1000 microseconds without damage, said conductive means being wound spirally around the nonconductive core;

an end cap mounted on each of the first and second ends of the insulative housing;

each end of the conductive means is connected to a respective end cap; and the time lag fuse is rated at substantially 350 mA and 600 volts direct current.

2. The time lag fuse of claim 1, wherein the fuse element is wound on the nonconductive core at substantially 120 to 150 turns per inch.

3. The time lag fuse of claim 1, wherein the fuse element is wound on the nonconductive core at substantially 123 to 137 turns per inch.

4. The time lag fuse of claim 2, wherein the core with the fuse element wound thereon has a resistance of substantially 32 to 34 ohms per foot.

5. The time lag fuse of claim 4, wherein the fuse element is a Cu/Ag wire having a diameter of substantially 0.0020 inches.

6. The time lag fuse of claim 5, wherein the fuse element is a 50% Cu/50% Ag wire having a diameter of substantially 0.0020 inches, and which is plated with tin.

7. The time lag fuse of claim 5, wherein the nonconductive core is comprised of a stranded ceramic material, and which includes an inorganic binder.

8. The time lag fuse of claim 5, wherein the nonconductive core is comprised of silicone.

9. The time lag fuse of claim 1, wherein the fuse element is wound on the nonconductive core at 120 to 150 turns per inch.

10. The time lag fuse of claim 1, wherein the fuse element is wound on the nonconductive core at 123 to 137 turns per inch.

11. The time lag fuse of claim 9, wherein the core with the fuse element wound thereon has a resistance of 32 to 34 ohms per foot.

12. The time lag fuse of claim 11, wherein the fuse element is a Cu/Ag wire having a diameter of 0.0020 inches.

13. The time lag fuse of claim 12, wherein the fuse element is a 50% Cu/50% Ag wire having a diameter of 0.0020 inches, and which is plated with tin.

14. The fuse of claim 1, wherein the conductive means is a Cu/Ag wire.

15. The fuse of claim 1, wherein the conductive means is a Cu/Ag wire that is plated with tin.

16. The fuse of claim 1, wherein the conductive means is plated with tin.

17. A time lag fuse, comprising:

an insulative housing having first and second ends and an outer diameter of substantially 3 mm;

a nonconductive core arranged inside the insulative housing and having a length of substantially 10 mm;

conductive means for withstanding 100 pulses that reach 14 peak amps within 10 microseconds and that will decay to a half-value in 1000 microseconds without damage, said conductive means being wound spirally around the nonconductive core, the conductive means is a wire having a resistance of substantially 3.410 ohms per foot and is wrapped around the core with substantially 120 to 150 turns per inch;

an end cap mounted on each of the first and second ends of the insulative housing; and each end of the fuse element is connected to a respective end cap.

18. The conductive means of claim 17, wherein the fuse is rated at 350 mA and 600 volts direct current.

19. The fuse of claim 17, wherein the conductive means is a Cu/Ag wire having a diameter of substantially 0.0020 inches.

20. The fuse of claim 17, wherein the fuse element is wrapped around the core with 123 to 137 turns per inch.

21. The fuse of claim 17, wherein the conductive means is a 50% Cu/50% Ag wire having a diameter of substantially 0.0020 inches, and which is plated with tin.

22. The fuse of claim 17, wherein the conductive means is a Cu/Ag wire having a diameter of 0.0020 inches.

23. The fuse of claim 9, wherein the conductive means is wrapped around the core with 123 to 137 turns per inch.

24. The fuse of claim 9, wherein the conductive means is a 50% Cu/50% Ag wire having a diameter of 0.0020 inches, and which is plated with tin.

25. A method of making a fuse comprising the steps of:

spirally winding a fuse element on an elongated nonconductive core;

threading sequentially on the wound core an assembly that includes a first conductive end cap, a fuse housing, and a second conductive end cap;

repeating the above-listed threading step until a plurality of assemblies have been threaded onto the wound core;

soldering the fuse element to each end cap; and severing the wound core between each assembly.

26. The method of claim 14, further including the step of securing the end caps to the fuse housing for each assembly.

27. The method of claim 15, wherein the securing step is done prior to the threading step.

28. The method of claim 15, wherein the securing step is done after the threading step.

29. The method of claim 26, wherein the fuse is rated at 350 mA at 600 V dc and is capable of withstanding 100 pulses that reach 14 peak amps within 10 microseconds and that decay to a half-value in 1000 microseconds without damage.

* * * * *